US012448584B2

(12) United States Patent
Cox et al.

(10) Patent No.: US 12,448,584 B2
(45) Date of Patent: Oct. 21, 2025

(54) DRY FILM LUBRICANT COMPOSITION

(71) Applicant: Dimachem Inc., Windsor (CA)

(72) Inventors: Steve Cox, Windsor (CA); Svetlana Surbatovic, Windsor (CA); Dean Patterson, Windsor (CA); Jill Desjardins, Windsor (CA)

(73) Assignee: Dimachem Inc., Windsor (CA)

( * ) Notice: Subject to any disclaimer, the term of this patent is extended or adjusted under 35 U.S.C. 154(b) by 0 days.

(21) Appl. No.: 17/974,817

(22) Filed: Oct. 27, 2022

(65) Prior Publication Data

US 2023/0127958 A1 Apr. 27, 2023

Related U.S. Application Data

(60) Provisional application No. 63/272,297, filed on Oct. 27, 2021.

(51) Int. Cl.

| | |
|---|---|
| ***C10M 169/00*** | (2006.01) |
| ***C10M 107/02*** | (2006.01) |
| ***C10M 119/20*** | (2006.01) |
| ***C10M 125/20*** | (2006.01) |
| ***C10M 131/02*** | (2006.01) |
| ***C10M 141/04*** | (2006.01) |
| ***C10M 153/04*** | (2006.01) |
| ***C10M 161/00*** | (2006.01) |
| ***C10M 177/00*** | (2006.01) |

(Continued)

(52) U.S. Cl.

CPC ..... *C10M 169/00* (2013.01); *C10M 107/02* (2013.01); *C10M 119/20* (2013.01); *C10M 125/20* (2013.01); *C10M 131/02* (2013.01); *C10M 141/04* (2013.01); *C10M 153/04* (2013.01); *C10M 161/00* (2013.01); *C10M 177/00* (2013.01); *C10M 2201/18* (2013.01); *C10M 2205/183* (2013.01); *C10M 2209/126* (2013.01); *C10M 2211/02* (2013.01); *C10M 2225/00* (2013.01); *C10N 2030/12* (2013.01); *C10N 2040/20* (2013.01); *C10N 2050/08* (2013.01)

(58) Field of Classification Search

CPC ..... C10M 169/00; C10M 107/02; C10M 119/20; C10M 125/20; C10M 131/02; C10M 141/04; C10M 153/04; C10M 161/00; C10M 177/00; C10M 2201/18; C10M 2205/183; C10M 2209/126; C10M 2211/02; C10M 2225/00; C10N 2030/12; C10N 2040/20; C10N 2050/08

See application file for complete search history.

(56) References Cited

U.S. PATENT DOCUMENTS

| | | | |
|---|---|---|---|
| 6,258,759 B1 | 7/2001 | Futahashi et al. | |
| 8,507,416 B2 | 8/2013 | Hatasaki et al. | |

(Continued)

FOREIGN PATENT DOCUMENTS

| | | | |
|---|---|---|---|
| CN | 103923732 A * | 7/2014 | |
| CZ | 282448 B6 * | 7/1997 | ..... C10M 103/02 |

(Continued)

*Primary Examiner* — Taiwo Oladapo

(74) *Attorney, Agent, or Firm* — Burris Law, PLLC

(57) ABSTRACT

A dry film lubricant composition includes: an anionic wax emulsion including carnauba wax and an anionic surfactant; water; a thickener; an organic solvent; a fluorosurfactant; a phosphate additive; and an alkaline agent.

18 Claims, 1 Drawing Sheet

(51) Int. Cl.

| | |
|---|---|
| *C10N 30/12* | (2006.01) |
| *C10N 40/20* | (2006.01) |
| *C10N 50/08* | (2006.01) |

(56) References Cited

U.S. PATENT DOCUMENTS

| | | | | |
|---|---|---|---|---|
| 2011/0045309 | A1 | 2/2011 | Reusmann et al. | |
| 2015/0329797 | A2 * | 11/2015 | Shiihashi | B21C 9/02 508/156 |
| 2015/0367605 | A1 | 12/2015 | Morikawa et al. | |
| 2016/0160150 | A1 * | 6/2016 | Mochizuki | C10M 137/04 427/372.2 |
| 2018/0355275 | A1 | 12/2018 | Oshita et al. | |
| 2019/0144685 | A1 * | 5/2019 | Dugan | C09D 191/06 106/271 |
| 2023/0077757 | A1 * | 3/2023 | Tsukamoto | C10M 129/40 |

FOREIGN PATENT DOCUMENTS

| | | | | | |
|---|---|---|---|---|---|
| ES | 2643314 | T3 | * | 11/2017 | C09D 5/002 |
| JP | 2867161 | B2 | * | 3/1999 | |
| JP | 2000119674 | | | 4/2000 | |
| JP | 2005298787 | A | * | 10/2005 | |
| JP | 2007161808 | A | * | 6/2007 | |
| JP | 2009209247 | A | * | 9/2009 | |
| JP | 4820098 | | | 11/2011 | |
| JP | 5418478 | | | 2/2014 | |
| KR | 101726095 | | | 4/2017 | |
| TW | 201525194 | A | * | 7/2015 | C10M 173/02 |
| WO | 2013073401 | | | 4/2015 | |
| WO | WO-2016053577 | A1 | * | 4/2016 | A01N 25/10 |

* cited by examiner

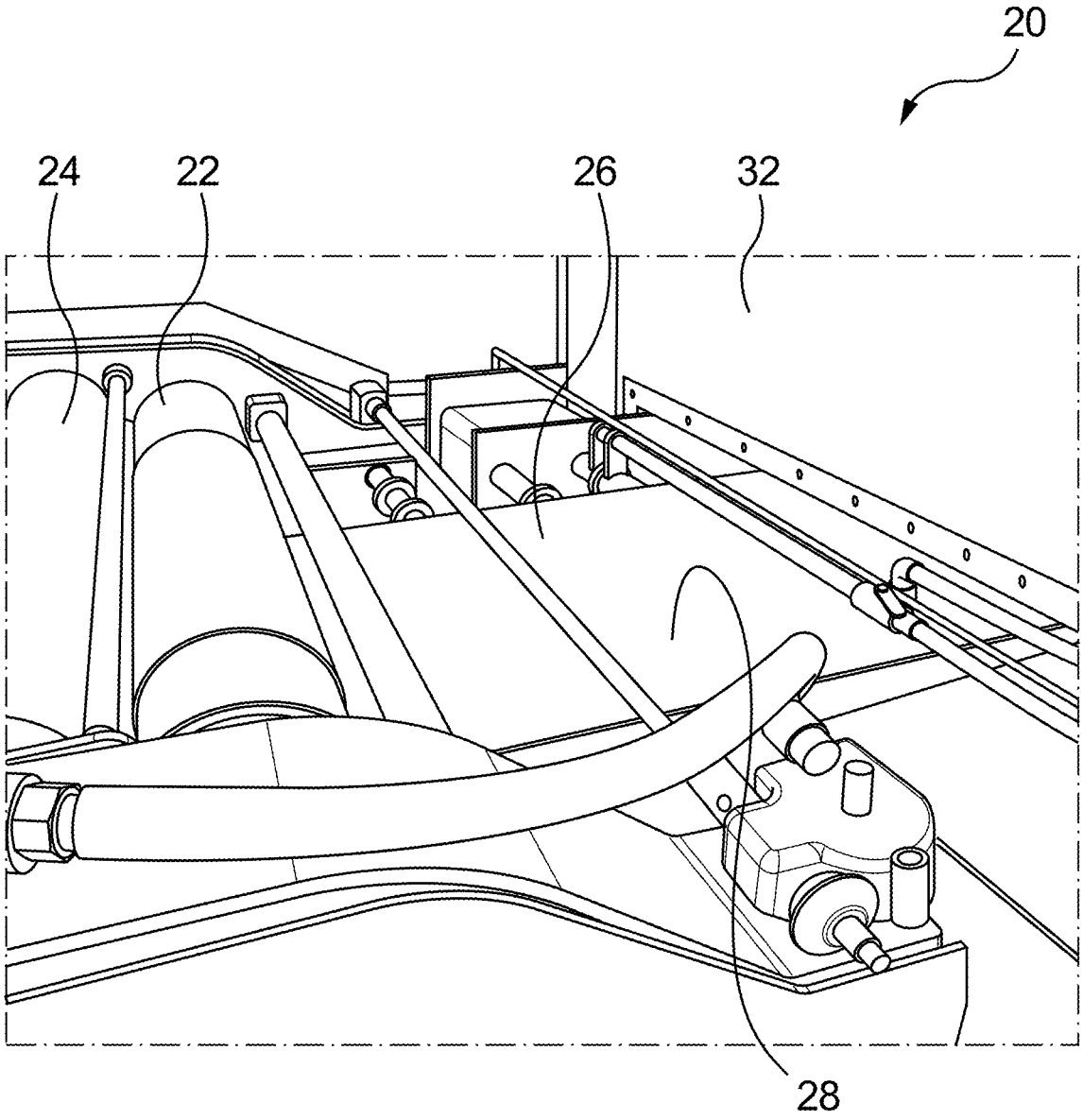
20
24
22
26
32
28

DRY FILM LUBRICANT COMPOSITION

CROSS-REFERENCE TO RELATED APPLICATIONS

This application claims priority to and the benefit of U.S. Provisional Application No. 63/272,297 filed on Oct. 27, 2021. The disclosure of the above application is incorporated herein by reference.

FIELD

The present disclosure relates to dry film lubricants and in particular, to a non-reactive dry film lubricant composition.

BACKGROUND

The statements in this section merely provide background information related to the present disclosure and may not constitute prior art.

In the field of metal working, dry film lubricants are typically applied to surfaces of metal sheet or metal blanks prior to metal forming operations, such as stamping, drawing, shearing, punching, and the like. The dry film lubricant coats the metal surface and inhibits the metal from experiencing damage, such as tearing or scoring, during the metal forming operation. After the metal forming operation, any residual dry film lubricant on the metal surface is typically removed.

Traditional lubricants for deep-drawn automotive parts, such as steel bumpers, are based on a dry coating of zinc stearate, which forms via chemical reaction of sodium stearate with a zinc phosphate-treated metal surface. To remove the zinc stearate coating, such as for a subsequent processing step such as electrocoating, a heavily chelated caustic cleaner is typically required.

As automotive technology continues to advance, the automotive industry is moving away from steel parts and toward parts fabricated of zinc alloys and aluminum alloys. However, as conventional heavily chelated caustic cleaners cannot be used with zinc and aluminum alloys due to chemical incompatibility, a different dry film lubricant composition is required.

Non-reactive dry film lubricant compositions are known. For example, U.S. Patent Publication No. 2015/0329797 to Shinashi et al. describes a water-soluble lubricating agent for plastic working capable of forming a lubricating film having lubricity and seizure resistance equal to or greater than a phosphorus-containing chemical conversion treatment film, having excellent corrosion resistance, and having good film adhesion, without including phosphorus in the film. This water-soluble non-phosphorus lubricating agent includes an inorganic solid lubricant as component A, a wax as component B, and a water-soluble inorganic metal salt as component C, wherein the mass ratio of solid of content component A to solid content of component B (component A/component B) is 0.1 to 5, and the mass percentage of solid content for component C to total solid content for components A, B and C (component C/(components A+B+C)) is 1 to 30%.

U.S. Patent Publication No. 2018/0355275 to Oshita et al. describes a solid lubricant that is non-black in color and capable of reducing industrial waste (environmental conservation) and further capable of achieving a balance among excellent lubricity, moisture absorption resistance, and corrosion resistance in a heavy working region, and a lubricating coating agent including the solid lubricant. In one form, the solid lubricant includes: carrier particles including a lipophilic lubricating component that is at least one of an oil, an extreme-pressure agent, a soap, and a wax between particles and/or layers of at least one layered clay mineral selected from the group consisting of natural products and synthetic products of a smectite group, a vermiculite group, a mica group, a brittle mica group, a pyrophyllite group, and a kaolinite group.

SUMMARY

This section provides a general summary of the disclosure and is not a comprehensive disclosure of its full scope or all of its features.

In one aspect, there is provided a dry film lubricant composition comprising: an anionic wax emulsion comprising carnauba wax, and an anionic surfactant; water; a thickener; an organic solvent; a fluorosurfactant; a phosphate additive; and an alkaline agent.

The anionic wax emulsion may further comprise a rust inhibitor.

The composition may comprise from 30 to 70% by weight of the anionic wax emulsion. The composition may comprise from 35 to 65% by weight of the anionic wax emulsion. The composition may comprise from 40 to 60% by weight of the anionic wax emulsion. The composition may comprise about 50% by weight of the anionic wax emulsion.

The water may be deionized water. The composition may comprise from 20 to 50% by weight of water. The composition may comprise from 25 to 45% by weight of water. The composition may comprise from 30 to 40% by weight of water. The composition may comprise about 35% by weight of water.

The thickener may be xanthan gum. The composition may comprise from 0.05 to 5% by weight of the thickener. The composition may comprise from 0.1 to 3% by weight of the thickener. The composition may comprise from 0.15 to 1% by weight of the thickener. The composition may comprise about 0.35% by weight of the thickener.

The organic solvent may be isopropyl alcohol. The composition may comprise from 1 to 30% by weight of organic solvent. The composition may comprise from 2 to 20% by weight of the organic solvent. The composition may comprise from 3 to 15% by weight of the organic solvent. The composition may comprise about 10% by weight of the organic solvent.

The composition may comprise from 0.01 to 0.50% by weight of the fluorosurfactant. The composition may comprise from 0.02 to 0.10% by weight of the fluorosurfactant. The composition may comprise about 0.05% by weight of the fluorosurfactant.

The phosphate additive may be polyether phosphate. The composition may comprise from 0.05 to 15% by weight of the phosphate additive. The composition may comprise from 0.5 to 10% by weight of the phosphate additive. The composition may comprise from 1 to 5% by weight of the phosphate additive. The composition may comprise about 2% by weight of the phosphate additive.

The alkaline agent may be ammonium hydroxide. The composition may comprise from 0.01 to 1% by weight of the alkaline agent. The composition may comprise from 0.03 to 0.5% by weight of the alkaline agent. The composition may comprise from 0.05 to 0.25% by weight of the alkaline agent. The composition may comprise about 0.12% by weight of the alkaline agent.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a photographic view of an apparatus for applying a dry film lubricant composition to a surface of sheet metal, in use.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The foregoing summary, as well as the following detailed description of the various forms of the present disclosure will be better understood when read in conjunction with the appended drawing. As used herein, an element or feature introduced in the singular and preceded by the word "a" or "an" should be understood as not necessarily excluding the plural of the elements or features. Further, references to "one example" or "one form" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the FIGURE. The spatially relative terms can however, encompass different orientations in use or operation in addition to the orientation depicted in the FIGURE.

The following is directed to a dry film lubricant composition that is wax-based. The dry film lubricant composition is applied in liquid form as a coating to a surface of sheet metal, such as coil or blank, prior to metal forming operations. The dry film lubricant composition is applied to the sheet metal surface using a suitable application process, such as roll coating. Once applied, the coating dries, and remains on the sheet metal surface as a dry film lubricant during one or more cycles of one or more metal forming operations. The metal forming operations may be, for example, stamping, drawing, shearing, punching, and the like.

After metal forming operations, any dry film lubricant remaining on the surface of the work product can be easily removed by rinsing with water.

FIG. 1 shows an exemplary apparatus for application of the dry film lubricant composition, and which is generally indicated by reference numeral 20. Apparatus 20 comprises a roll coater comprising a roller 22, and a dispenser 24 configured to dispense liquid dry film lubricant composition (namely, the dry film lubricant composition in liquid form) onto the surface of the roller 22. The roller 22 is in contact with the surface of a moving metal sheet 26, and is configured to apply the liquid dry film lubricant composition as a coating 28 onto the surface of the metal sheet 26. Downstream of the roller 22, the metal sheet 26 with the coating 28 thereon is moved through an oven 32. The coating 28 dries as it passes through the oven 32, thereby forming the dry film lubricant on the surface of the metal sheet 26.

The dry film lubricant composition comprises an aqueous solution of an anionic wax emulsion in water. The anionic wax emulsion comprises carnauba wax, an anionic surfactant to provide water solubility and to stabilize the emulsion, and an optional rust inhibitor. In this form, the anionic surfactant is dodecylbenzene sulfonic acid (DDBSA), however in other variations, other suitable anionic surfactants may alternatively be used. In one form, the dry film lubricant composition comprises from 30 to 70% by weight of the anionic wax emulsion. More particularly, the dry film lubricant composition comprises 35 to 65% by weight of the anionic wax emulsion, 40 to 60% by weight in a variation, and about 50% by weight in another variation. The aqueous solution comprises the anionic wax emulsion in deionized water, in distilled water, or in a combination thereof. In one form, the dry film lubricant composition comprises from 20 to 50% by weight of deionized water. More particularly, the dry film lubricant composition comprises 25 to 45% by weight of deionized water in a variation, 30 to 40% by weight in another variation, and about 35% by weight in another variation.

The dry film lubricant composition also comprises a thickener to improve thickness uniformity during application of the dry film lubricant composition to the surface of the sheet metal. In this form, the thickener is xanthan gum, however in other variations other suitable thickeners may alternatively be used. In one form, the dry film lubricant composition comprises from 0.05 to 5% by weight of the thickener. More particularly, the dry film lubricant composition comprises 0.1 to 3% by weight of the thickener in a variation, 0.15 to 1% by weight in another variation, and about 0.35% by weight in another variation.

The dry film lubricant composition further comprises an organic solvent to reduce the drying time of the coating. In this form, the organic solvent is isopropyl alcohol, however in other variations, other suitable organic solvents may alternatively be used. In one form, the dry film lubricant composition comprises from 1 to 30% by weight of the organic solvent. More particularly, the dry film lubricant composition comprises 2 to 20% by weight of the organic solvent, 3 to 15% by weight in another variation, and about 10% in another variation.

The dry film lubricant composition also comprises a fluorosurfactant to increase wetting of the sheet metal surface by the liquid dry film lubricant composition. As will be understood, increasing wetting of the sheet metal surface allows the coating of the liquid dry film lubricant composition to more easily extend to the edge of the sheet metal surface, and to remain extended to the edge once applied, even if the sheet metal surface is milled or otherwise has surface topography. In this form, the fluorosurfactant is CAPSTONE™ FS-3100, manufactured by The Chemours Company of Wilmington, Delaware, U.S.A., however it will be understood that this is merely an example of a fluorosurfactant and that in other variations, other suitable fluorosurfactants may alternatively be used. In one form, the dry film lubricant composition comprises from 0.001 to 1% by weight of the fluorosurfactant. More particularly, the dry film lubricant composition comprises 0.01 to 0.50% by weight of the fluorosurfactant, 0.02 to 0.10% by weight in another variation, and about 0.05% by weight in another variation.

The dry film lubricant composition further comprises a phosphate additive to improve performance of the dry film lubricant in the high-pressure conditions experienced during metal forming operations. In this form, the phosphate additive is polyether phosphate, however in other variations, other suitable phosphate additives may alternatively be used. In one form, the dry film lubricant composition comprises from 0.05 to 15% by weight of the phosphate additive. More particularly, the dry film lubricant composition comprises 0.5 to 10% by weight of the phosphate additive, 1 to 5% by weight in another variation, and about 2% by weight in another variation.

The dry film lubricant composition also comprises an alkaline agent to increase pH of the dry film lubricant composition, so as to increase stability of the coating. In particular, by increasing the pH, the alkaline agent inhibits bacterial growth and also ensures that the coating provides rust inhibition to the metal sheet. In this form, the alkaline agent is ammonium hydroxide, however in other variations, other suitable alkaline agents may alternatively be used. In one form, the dry film lubricant composition comprises from 0.01 to 1% by weight of the alkaline agent. More particularly, the dry film lubricant composition comprises 0.03 to 0.5% by weight of the alkaline agent, 0.05 to 0.25% by weight in another variation, and about 0.12% by weight in another variation.

In use, the dry film lubricant composition is applied in liquid form as a coating to one or both surfaces of the metal sheet using a suitable application process. The coating is applied in an amount ranging from about 100 to about 300 $mg/ft^2$ (or about 1.076 to about 3.229 $g/m^2$). The coated metal sheet is then passed through the oven to dry the coating. The oven may be at a temperature of from room temperature up to about 400° F. (about 204° C.). At an oven temperature of 200° F. (about 93° C.), a coating applied in an amount of 200 $mg/ft^2$ (about 2.152 $g/m^2$) dries in about twenty (20) seconds, while at room temperature the coating dries in about two (2) minutes. Upon drying, the dry film lubricant is formed on the surface of the metal sheet, and the metal sheet may then be subjected to metal forming operations. The dry film lubricant may be removed from the surface of the metal sheet, either before, during or after metal forming operations, by rinsing with water.

As will be appreciated, the water solubility of the dry film lubricant composition allows the dry film lubricant to be easily removed from the surface of the work product (namely, the sheet metal formed by the one or more metal forming operations) by simply rinsing with water. This advantageously allows the surface of the work product to be more easily cleaned for subsequent processing steps, such as electrocoating, as compared to conventional dry film lubricants, such as the zinc stearate coating obtained by reacting the zinc phosphate-treated metal surface with sodium stearate. As will be understood, such conventional dry film lubricants can only be cleaned using heavily chelated, caustic cleaners that can damage the surface of the work product. Additionally, such caustic cleaners are otherwise chemically incompatible with work products formed from zinc alloys or aluminum alloys, which are increasingly being used in industries such as the automotive industry.

As will be appreciated, the dry film lubricant composition is advantageously water-based and does not comprise any oil, which can otherwise leave oily deposits on the surface of the work product that can interfere with subsequent processing steps, such as electrocoating, if not completely removed. Removal of such oily deposits requires use of a suitable organic solvent. In contrast, the water solubility of the dry film lubricant composition allows the dry film lubricant to be completely removed easily and in a cost-effective manner.

It will be understood that the advantages outlined above are not limited to the work product (namely, the sheet metal formed by the one or more metal forming operations), and also apply to the sheet metal prior to being subjected to the one or more metal forming operations.

In other variations, the dry film lubricant composition may be different. For example, although in the form described above, the anionic surfactant is dodecylbenzene sulfonic acid (DDBSA), in other forms, the anionic surfactant may alternatively be, for example, one or more of dodecylbenzene sulfonic acid (DDBSA), ammonium lauryl sulfate (ALS), sodium lauryl ether sulfate (SLES), sodium lauryl sulfate (SLS), and combinations thereof. Still other suitable anionic surfactants may alternatively be used.

Although in the form described above, the thickener is xanthan gum, in other variations, the thickener may alternatively be, for example, one or more of xanthan gum, hydroxyethyl cellulose, hydroxymethyl cellulose, hydroxypropyl methylcellulose, and combinations thereof. Still other suitable thickeners may alternatively be used.

Although in the form described above, the organic solvent is isopropyl alcohol, in other variations, the organic solvent may alternatively be, for example, one or more of isopropyl alcohol, ethyl alcohol, butyl CELLOSOLVE™, butyl CARBITOL™, propylene glycol, and combinations thereof. Still other suitable organic solvents may alternatively be used.

Although in the form described above, the fluorosurfactant is CAPSTONE™ FS-3100, in other variations, the fluorosurfactant may alternatively be, for example, one or more partially-fluorinated alcohol substituted glycols, such as for example polyethylene oxide, mono (3,3,4,4,5,5,6,6,7,7,8,8,8-tridecafluorooctyl) ether, with brand names such as CAPSTONE™ FS-3100, CAPSTONE™ FS-34, CAPSTONE™ FS-35, and combinations thereof. Still other suitable fluorosurfactants may alternatively be used.

Although in the form described above, the phosphate additive is polyether phosphate, in other variations, the phosphate additive may alternatively be, for example, one or more of polyether phosphate, polyethylene glycol phenyl ether phosphate, oleyl alcohol ethoxylate phosphate, phosphoric acid, and combinations thereof. Still other suitable phosphate additives may alternatively be used.

Although in the form described above, the alkaline agent is ammonium hydroxide, in other variations, the alkaline agent may alternatively be, for example, one or more of ammonium hydroxide, 2-amino-2-methyl-1-propanol, potassium hydroxide, sodium hydroxide, sodium carbonate, potassium carbonate, and combinations thereof. Still other suitable alkaline agents may alternatively be used.

The following examples illustrate various applications of the above-described forms. It will be understood that materials (for example, emulsions, chemicals, compounds, solvents, and the like) and their manufacturers mentioned in the following examples are merely examples and are no way limiting, and that other suitable materials made by other manufacturers may alternatively be used in variations of the present disclosure.

Example 1

In this example, coatings of experimental dry film lubricant compositions having different concentrations of polymer emulsion were applied to the surfaces of sheet metal blanks to determine i) whether the coating could be dried in an oven in 20 seconds and ii) the lowest oven temperature needed to achieve drying within 20 seconds.

The polymer emulsion used was CARBOSET™ 514H, manufactured by Lubrizol Corporation of Wickliffe, Ohio, U.S.A. CARBOSETT 514H is an acrylic colloidal suspension in an ammonia/water solution. The concentrations tested were 100%, 50% and 25% by weight of the composition. The coatings were applied in amounts ranging from 100 to 300 mg/ft$^2$.

For the 25% composition, drying within 20 seconds was achieved at an oven temperature of 200° C.

Example 2

In this example, pairs of two (2) samples of the coated sheet metal blanks coated with the 25% composition dried at the oven temperature of 200° C. from Example 1 were clamped together immediately upon removal from the drying oven, held in a clamped state for twenty-four (24) hours, and then separated by removing the clamps, to determine whether any tackiness existed between the clamped, coated blanks.

Each sample was found to separate freely and smoothly from the other sample of the pair and no tackiness was observed, satisfying the release criterion for this lubricant composition.

Example 3

In this example, one hundred and twenty (120) samples of the coated sheet metal blanks coated with the 25% composition and dried at the oven temperature of at 200° C. from Example 1 were subjected to cold drawing operations to determine the effectiveness of the coating as a lubricant.

The sheet metal material of the samples was found to fail catastrophically during the cold drawing operations. It was determined that the polymer emulsion of the CARBOSETT 514H did not provide sufficient lubricity.

Example 4

In this example, coatings of experimental dry film lubricant compositions having different carnauba wax emulsions were applied to the surfaces of sheet metal blanks to determine i) whether the coating could be dried in an oven in 20 seconds and ii) the lowest oven temperature needed to achieve drying within 20 seconds.

The carnauba wax emulsions tested were MICHEM™ Lube 160PFP and MICHEM™ Emulsion 67135, both manufactured by Michelman Inc. of Cincinnati, Ohio, U.S.A. The concentration tested was 100%. Drying times were observed at room temperature and in an oven at 200° C. The coating weight was also measured. The results are shown in Table 1:

TABLE 1

| | MICHEM ™ Lube 160PFP | MICHEM ™ Emulsion 67135 |
|---|---|---|
| Dry within 1 min at RT? | no | no |
| Dry within 5 sec at 200° C.? | yes | yes |
| Avg, coating weight (mg/ft$^2$) | 331.13 | 626.73 |

Example 5

In this example, coatings of experimental dry film lubricant compositions comprising MICHEM™ Emulsion 67135 (30% by weight) and water (70% by weight) were applied to the surfaces of sheet metal blanks to i) determine if the coating spread easily to the edges of the sheet metal blank, and ii) whether the coating pulled back after extending to the edges.

It was observed that the coating pulled back from each edge by about 10% of the dimension of the blank, after having extended to the edge.

Example 6

In this example, coatings of experimental dry film lubricant compositions comprising MICHEM™ Emulsion 67135 (30% by weight), a fluorosurfactant (0.1% by weight), an organic solvent (10% by weight) and deionized water (49.9% by weight) was applied to the surfaces of sheet metal blanks to i) determine if the coating spread easily to the edges of the sheet metal blank, and ii) whether the coating pulled back after extending to the edges. The fluorosurfactant was CAPSTONE™ FS-3100, manufactured by The Chemours Company of Wilmington, Delaware, U.S.A., and the organic solvent was isopropyl alcohol (IPA).

It was observed that the coating spread easily to the edges, but then pulled back from each edge. However, the amount of pull back and the rate of pull back were noticeably less than those observed for the composition of Example 5.

The average coating weight was 23.22 mg/ft$^2$.

Example 7

In this example, coatings of experimental dry film lubricant compositions comprising increasing amounts of MICHEM™ Emulsion 67135 (greater than 30% by weight), a fluorosurfactant (0.1% by weight), and decreasing amounts of deionized water (less than 59.9% by weight) was applied to the surfaces of sheet metal blanks to reach a target coating weight of 200 mg/ft$^2$. The fluorosurfactant was CAPSTONE™ FS-3100. The compositions tested are shown in Table 2:

TABLE 2

| | MICHEM ™ Emulsion 67135 (wt. %) | CAPSTONE ™ FS-3100 (wt. %) | Deionized water (wt. %) |
|---|---|---|---|
| Composition A | 30 | 0.1 | 69.9 |
| Composition B | 40 | 0.1 | 59.9 |
| Composition C | 50 | 0.1 | 49.9 |
| Composition D | 60 | 0.1 | 39.9 |
| Composition E | 70 | 0.1 | 29.9 |
| Composition F | 80 | 0.1 | 19.9 |
| Composition G | 90 | 0.1 | 9.9 |

It was observed that the target coating weight was achieved with Composition F, which had an average coating weight was 206.11 mg/ft$^2$.

Although various forms of the present disclosure have been described above, those of skill in the art will appreciate that variations and modifications may be made without departing from the scope thereof as defined by the appended claims.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A dry film lubricant composition, consisting of:
an anionic wax emulsion consisting of:
carnauba wax,
an anionic surfactant, and
an optional rust inhibitor;
water;
a thickener;
an organic solvent;
a fluorosurfactant;
a phosphate additive; and
an alkaline agent.

2. The composition of claim 1, wherein the composition comprises from 30 to 70% by weight of the anionic wax emulsion.

3. The composition of claim 1, wherein the composition comprises from 40 to 60% by weight of the anionic wax emulsion.

4. The composition of claim 1, wherein the water is deionized water.

5. The composition of claim 1, wherein the composition comprises from 20 to 50% by weight of water.

6. The composition of claim 1, wherein the composition comprises from 30 to 40% by weight of water.

7. The composition of claim 1, wherein the thickener is xanthan gum.

8. The composition of claim 1, wherein the composition comprises from 0.05 to 5% by weight of the thickener.

9. The composition of claim 1, wherein the composition comprises from 0.15 to 1% by weight of the thickener.

10. The composition of claim 1, wherein the organic solvent is isopropyl alcohol.

11. The composition of claim 1, wherein the composition comprises from 1 to 30% by weight of organic solvent.

12. The composition of claim 1, wherein the composition comprises from 3 to 15% by weight of the organic solvent.

13. The composition of claim 1, wherein the composition comprises from 0.01 to 0.50% by weight of the fluorosurfactant.

14. The composition of claim 1, wherein the composition comprises from 0.02 to 0.10% by weight of the fluorosurfactant.

15. The composition of claim 1, wherein the phosphate additive is polyether phosphate.

16. The composition of claim 1, wherein the composition comprises from 0.05 to 15% by weight of the phosphate additive.

17. The composition of claim 1, wherein the alkaline agent is ammonium hydroxide.

18. The composition of claim 1, wherein the composition comprises from 0.01 to 1% by weight of the alkaline agent.

* * * * *